US010843495B2

(12) United States Patent
Kobayashi et al.

(10) Patent No.: US 10,843,495 B2
(45) Date of Patent: Nov. 24, 2020

(54) POWER SUPPLY DEVICE, CONVEYANCE APPARATUS, AND IMAGE FORMING APPARATUS

(71) Applicants: Masato Kobayashi, Kanagawa (JP); Hirohito Murate, Kanagawa (JP); Seiichi Ishiduka, Kanagawa (JP)

(72) Inventors: Masato Kobayashi, Kanagawa (JP); Hirohito Murate, Kanagawa (JP); Seiichi Ishiduka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/579,248

(22) Filed: Sep. 23, 2019

(65) Prior Publication Data

US 2020/0101775 A1 Apr. 2, 2020

(30) Foreign Application Priority Data

Sep. 28, 2018 (JP) ..... 2018-184434

(51) Int. Cl.
*B41J 23/32* (2006.01)
*B41J 11/00* (2006.01)

(52) U.S. Cl.
CPC ..... *B41J 23/32* (2013.01); *B41J 11/007* (2013.01)

(58) Field of Classification Search
CPC ..... B41J 23/32; B41J 11/007; B41J 29/38; G03G 15/80
USPC ..... 347/101, 104
See application file for complete search history.

(56) References Cited

U.S. PATENT DOCUMENTS

| | | | | |
|---|---|---|---|---|
| 9,075,376 | B2 * | 7/2015 | Utagawa | G03G 15/70 |
| 9,195,194 | B2 * | 11/2015 | Kishimoto | G03G 21/1633 |
| 9,939,773 | B2 * | 4/2018 | Hanayama | G03G 15/5004 |
| 2013/0315610 | A1 | 11/2013 | Utagawa et al. | |

FOREIGN PATENT DOCUMENTS

| | | |
|---|---|---|
| JP | 2013-247575 | 12/2013 |
| JP | 2014-164200 | 9/2014 |
| JP | 2017-017813 | 1/2017 |

* cited by examiner

*Primary Examiner* — An H Do
(74) *Attorney, Agent, or Firm* — Duft & Bornsen, PC

(57) ABSTRACT

A power supply device includes a power supply line, control circuitry, and a first switch. The power supply line supplies voltage from a first power supply unit to a load. The control circuitry controls voltage supply from the first power supply unit. The first switch is connected between a second power supply unit and the control circuitry. The control circuitry causes the first power supply unit to start the voltage supply on condition that the first switch is in a closed state and a voltage of the power supply line is not greater than a first threshold voltage, and causes the first power supply unit to start the voltage supply on condition that the voltage of the power supply line is not greater than a second threshold voltage higher than the first threshold voltage when the first switch changes from an open state to the closed state.

17 Claims, 7 Drawing Sheets

POWER SUPPLY DEVICE, CONVEYANCE APPARATUS, AND IMAGE FORMING APPARATUS

CROSS-REFERENCE TO RELATED APPLICATION

This patent application is based on and claims priority pursuant to 35 U.S.C. § 119(a) to Japanese Patent Application No. 2018-184434, filed on Sep. 28, 2018, in the Japan Patent Office, the entire disclosure of which is hereby incorporated by reference herein.

BACKGROUND

Technical Field

Aspects of the present disclosure relate to a power supply device, a conveyance apparatus, and an image forming apparatus.

Related Art

Conventionally, when power is supplied to the load side while charge is stored in a capacitor of a power supply unit (PSU), an overcurrent flows to the load side due to residual charge stored in the capacitor, and an electronic component on the load side may fail. Therefore, there is a technique of supplying power after the voltage of the capacitor has decreased to a fixed value.

There is also known a technique of supplying power in a case where the voltage change rate of a power supply line reaches a threshold.

SUMMARY

In an aspect of the present disclosure, there is provided a power supply device that includes a power supply line, control circuitry, and a first switch. The power supply line is configured to supply a voltage from a first power supply unit to a load. The control circuitry is configured to control voltage supply from the first power supply unit. The first switch is connected between a second power supply unit and the control circuitry. The control circuitry is configured to cause the first power supply unit to start the voltage supply on condition that the first switch is in a closed state and a voltage of the power supply line is not greater than a first threshold voltage, and cause the first power supply unit to start the voltage supply on condition that the voltage of the power supply line is not greater than a second threshold voltage higher than the first threshold voltage when the first switch changes from an open state to the closed state.

In another aspect of the present disclosure, there is provided an image forming apparatus that includes the power supply device, a conveyer configured to convey a recording medium, and an image forming device configured to form an image on the recording medium.

In still another aspect of the present disclosure, there is provided a power supply device that includes a first power supply unit, a second power supply unit, a motor unit, a power supply line, a control unit, and a first switch. The motor unit is configured to receive a voltage supplied from the first power supply unit. The power supply line is connected to the motor unit and the first power supply unit. The control unit is connected to the first power supply unit. The first switch is connected between the second power supply unit and the control unit. The control unit is configured to cause the first power supply unit to supply the voltage to the power supply line in a case where the voltage supplied from the second power supply unit is shut off by the first switch and a voltage of the power supply line is not greater than a first threshold voltage, and cause the first power supply unit to supply the voltage to the power supply line in a case where the voltage of the power supply line is not greater than a second threshold voltage, which is greater than the first threshold voltage when the switch changes from a shutoff state to a connection state in which the voltage from the second power supply unit is supplied.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
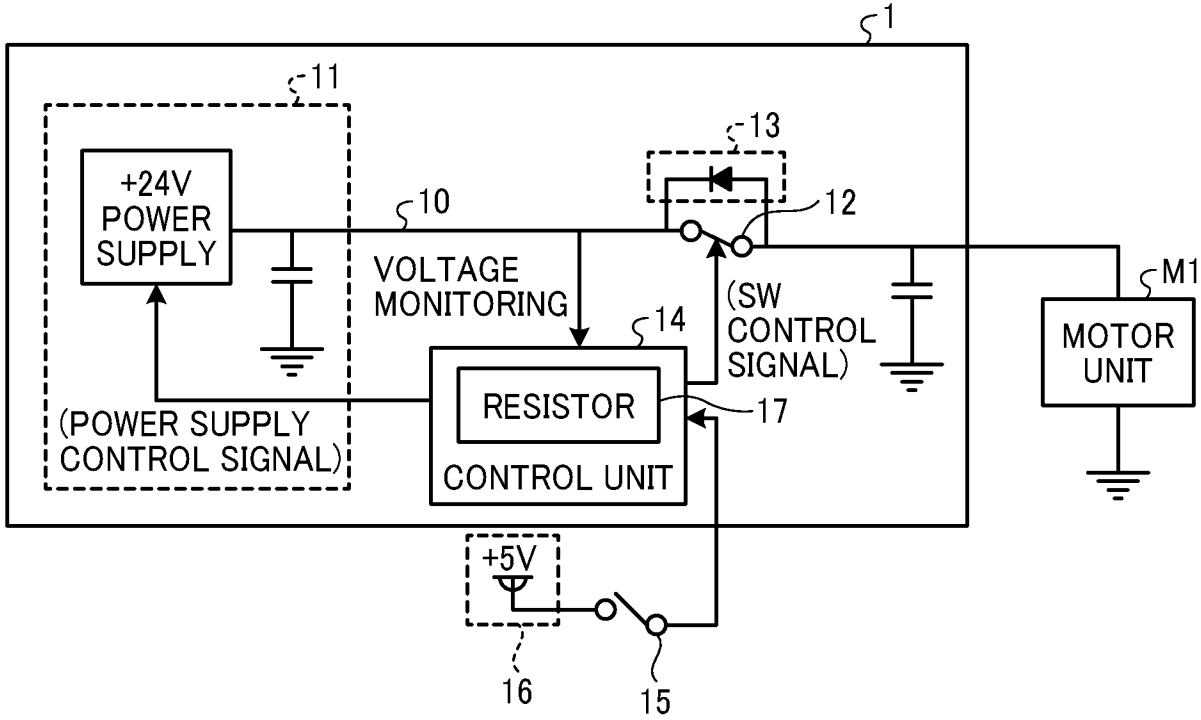
FIG. 1 is a diagram illustrating an example of arrangement of a power supply device according to a first embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Hereinafter, embodiments of a power supply device, a conveyance apparatus, and an image forming apparatus according to the present invention will be described in detail with reference to the attached drawings. Note that the embodiments described below are preferred embodiments of the present invention, and therefore, various technically preferable limitations are added. However, the scope of the present invention is not unduly limited by the following description. In addition, not all of the configurations described in the present embodiments are essential constituents of the present invention.

First Embodiment

FIG. 1 is a diagram illustrating an example of arrangement of a power supply device according to a first embodiment. A power supply device (hereinafter also referred to as a power supply unit (PSU)) 1 illustrated in FIG. 1 includes a power supply unit 11, a switching switch (SW) 12, a rectifier 13, and a control unit 14. On the load side of the power supply device 1, a motor unit M1 is illustrated as an example of a load. An interlock SW 15 for interlocking is connected to the power supply device 1. The interlock SW 15 allows a voltage to be supplied from the power supply unit 16 to the control unit 14 when the switch is turned on, and shuts off voltage supply from the power supply unit 16 to the control unit 14 when the switch is turned off. Note that the interlock SW 15 is an example, and it is sufficient that the interlock SW 15 is a switch (first switch) that is connected between the power supply unit 16 to the control unit 14 and switches between supply and shutoff of the voltage from the power supply unit 16 to the control unit 14. In addition, the first switch may be included in the power supply device 1. Hereinafter, as an example, a state where the interlock SW 15 is turned OFF is an open state, and a state where the interlock SW 15 is turned ON is a closed state. Here, the power supply unit 11 corresponds to a "first power supply unit". The power supply unit 16 corresponds to a "second power supply unit". The switching SW 12 corresponds to a "second switch". The control unit 14 corresponds to a "controller" or "control circuitry".

The power supply unit 11 supplies voltage to the load through a power supply line 10 for power supply.

The switching SW 12 is a switch that is connected between the power supply line 10 and the motor unit M1 as the load and switches between ON/OFF to make the power supply line 10 conductive or cut off.

The rectifier 13 enables a current to flow from the load side to the power supply unit 11. In FIG. 1, a diode is provided as an example of the rectifier 13. In this arrangement, the diode is connected to the power supply line 10 in parallel to the switching SW 12. For example, it is assumed that a mechanism driven by the motor unit M1 is operated manually. In this case, the motor of the motor unit M1 becomes a generator to generate electromotive force. The charge generated due to the electromotive force generated on the load side passes through the diode which is the rectifier 13, and the difference from charge of the power supply unit 11 is almost eliminated. Therefore, in a case where there is charge generated due to electromotive force on the load side, an overcurrent does not flow to the load side even if power is supplied from the power supply unit 11.

The motor unit M1 includes a motor which is an example of a winding load. For example, the motor unit M1 is a drive motor of a conveyance path for conveying a recording medium (such as a paper sheet) in a printer. The mechanism, for example, a drive mechanism (conveyance roller, a gear, and the like) driven by the motor is connected to the motor of the motor unit M1.

The control unit 14 uses a SW control signal to switch the switching SW 12 according to ON/OFF of a main power supply. The control unit 14 also monitors the voltage of the power supply line 10 and controls power supply of the power supply unit 11 according to the voltage of the power supply line 10 and the state of the interlock SW 15. Specifically, the control unit 14 determines whether or not power can be output from the power supply unit 11 according to the state of the interlock SW 15 and the magnitude of the voltage of the power supply line 10, and outputs to the power supply unit 11, a control signal (for example, an enable signal when output is enabled) enabling output or disabling output. Here, it is assumed that the conditions for enabling output power from the power supply unit 11 are as follows: the interlock SW 15 is in the closed state and the voltage of the power supply line 10 is less than or equal to a predetermined threshold. In the present embodiment, a threshold a which is a first threshold voltage and a threshold b which is a second threshold voltage are used.

The threshold a is used for determination made when the interlock SW 15 is in a closed state. The threshold value b is used in determination made when the interlock SW 15 becomes closed. When the interlock SW 15 is in the closed state, residual charge is accumulated in the capacitor of the power supply unit 11 (charged state). Therefore, if power is supplied when electromotive force is generated in that state, there is a possibility that a rush current will flow through the power supply line 10 since the switching SW 12 is remained to be ON. Therefore, when the interlock SW 15 is closed, the threshold a at which the residual charge of the capacitor of the power supply unit 11 is discharged is set. In a case where the interlock SW 15 opens and the residual charge of the capacitor of the power supply unit 11 is discharged, the threshold b is set in order to prevent erroneous detection due to electromotive force in determination made when the interlock SW 15 is closed again. It is assumed that the threshold b is higher than the threshold a.

The control unit 14 compares the voltage of the power supply line 10 with the thresholds a and b, determines that output is enabled when the above conditions are satisfied, and outputs a power supply control signal indicating that output is enabled to the power supply of the power supply unit 11.

Figure 2:
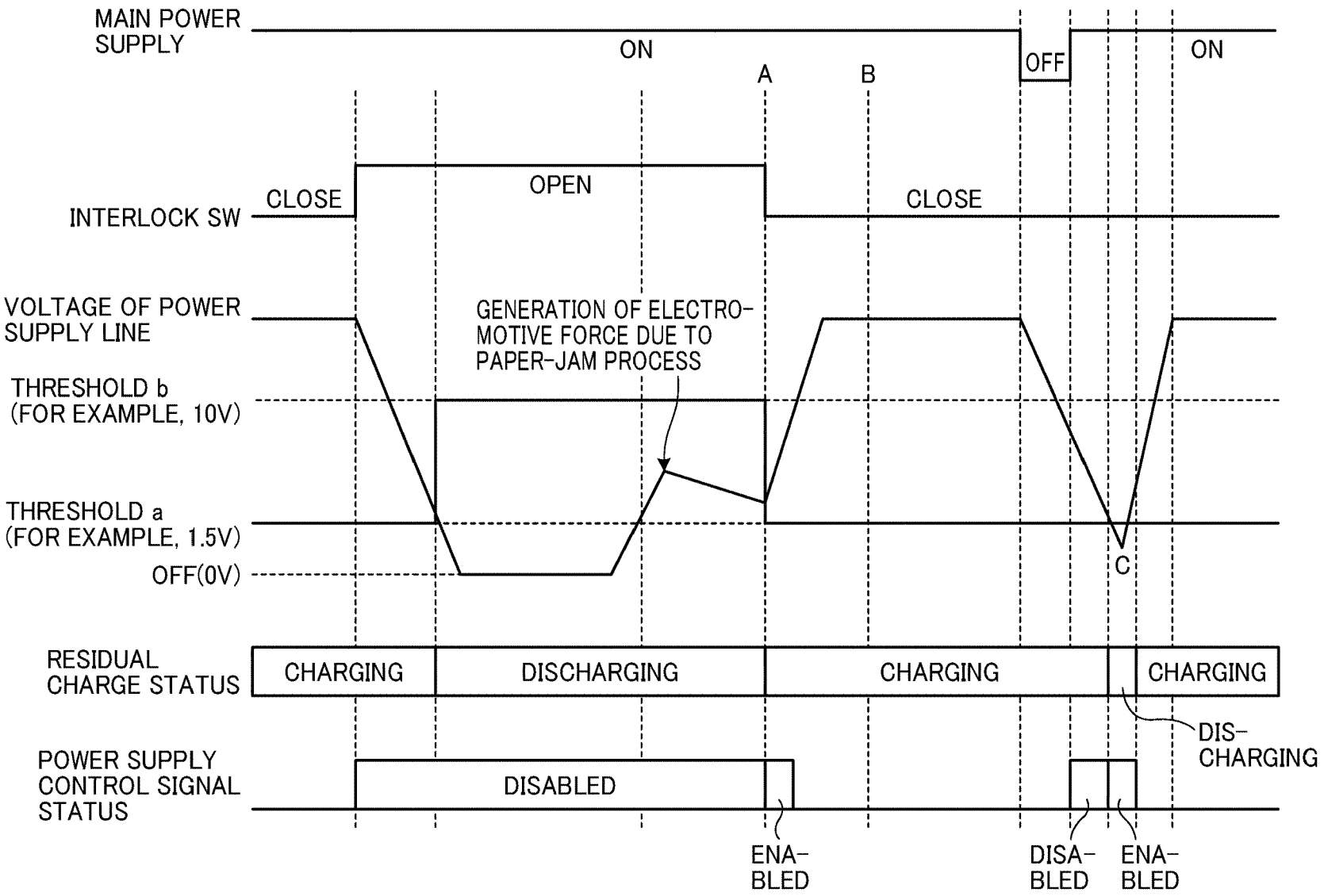
FIG. 2 is a graph illustrating an example of a timing chart of the power supply device.
Figure 3:
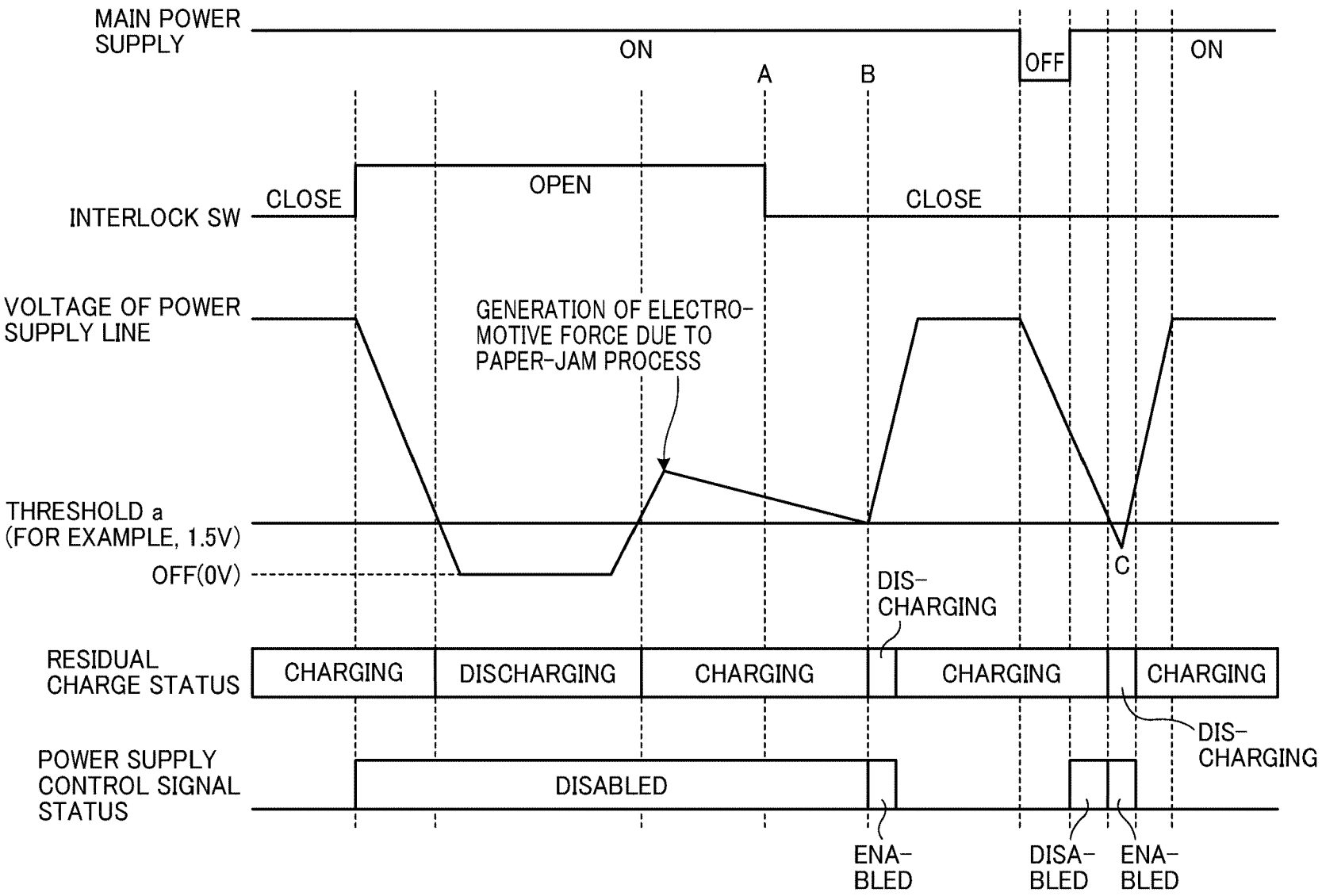
FIG. 3 is a graph illustrating a timing chart in a power supply device having conventional arrangement for comparison with FIG. 2.

FIGS. 2 and 3 are graphs explaining timing charts for the control unit 14 to control each unit. FIG. 2 is a graph illustrating an example of the timing chart of the power supply device according to the present embodiment. FIG. 3 is a graph illustrating the timing chart in a power supply device having conventional arrangement for comparison with FIG. 2. Hereinafter, a case where the power supply of the power supply unit 11 is a +24V power supply will be described as an example. Note that the +24V power supply is an example, and the present invention is not limited to this. Hereinafter, it is assumed that the operation is common in the timing charts of FIGS. 2 and 3 unless otherwise specified in particular.

First, in a case where the main power supply is in an ON state, that is, the switching SW 12 is turned ON and the interlock SW 15 is in an open state, the control unit 14 outputs a power supply control signal indicating that output is disabled. In this case, the supply of voltage from the power supply unit 11 is stopped, and the voltage of the power supply line 10 drops. When the voltage of the power supply line 10 falls below the threshold a (for example, 1.5 V), the status of residual charge changes from during charging to discharging.

In this state, it is assumed that the mechanism driven by the motor unit M1 is manually operated. For example, the mechanism operates when a user pulls out a recording medium jammed in the conveyance path from the conveyance path at the time of a paper jam process of the printer. In this case, electromotive force higher than the threshold a is generated in the power supply line 10. The rise from the OFF (0V) of the voltage of the power supply line 10 represents electromotive force generated at that time.

As illustrated in FIG. 3, in the conventional arrangement, if the generated electromotive force exceeds the threshold a and then the interlock SW 15 is closed, the control unit 14 continues to output the power supply control signal disabling output until the voltage of the power supply line 10 falls below the threshold a. Therefore, power supply is not started. In this case, the control unit 14 outputs a power supply control signal enabling output at a point B where the voltage is less than or equal to the threshold a, and power supply is started.

In contrast, in the power supply device 1 according to the present embodiment, as illustrated in FIG. 2, the threshold value b, which is higher than the threshold value a, is used as the condition for enabling and disabling output. Here, the threshold value b is a voltage value (10V as an example) higher than the maximum voltage (electromotive force of the winding load) of the motor unit M1 when the mechanism is operated manually. In this case, at a point A where the interlock SW 15 is closed from the open state, the voltage of the power supply line 10 falls below the threshold b to satisfy the condition. Therefore, at the time point when the interlock SW 15 is closed, the control unit 14 outputs a power supply control signal enabling output, and supplies voltage from the power supply unit 11 to the load.

Then, in a case where the main power supply is turned OFF while the interlock SW 15 is in the closed state and then is turned on immediately, the operation is similar to the operation in the conventional arrangement. That is, since the main power supply is turned OFF once, the supply of voltage from the power supply unit 11 to the load side is stopped, and the voltage of the power supply line 10 drops. Even if the main power supply is turned ON during the drop, the voltage of the power supply line 10 does not fall below the threshold a. Therefore, the control unit 14 does not output the power supply control signal enabling output and the power supply unit 11 does not supply voltage to the load until the voltage of the power supply line 10 falls below the threshold a. The control unit 14 outputs a power supply control signal enabling output at a point C where the voltage is less than or equal to the threshold value a, and the power supply unit 11 supplies voltage to the load side.

Note that the thresholds with which the voltage of the power supply lines 10 is compared are determined by a resistor 17. In the case of using a variable device (for example, a variable resistor) that varies resistance, even in a case where the motor unit M1 is changed, easily varying the thresholds without changing components enables optimum voltage supply.

In a capacitor of a PSU, a part of charge of the capacitor may be accumulated by an electromotive force generated on the load side. For example, at the time of a paper jam process in an image forming apparatus such as a printer or a multifunctional peripheral (MFP), electromotive force is generated when a user pulls out a recording sheet jammed in a conveyance path from the conveyance path, and charge is accumulated. When the recording sheet is pulled out, a conveyance roller that holds the recording sheet also rotates, and a drive motor of the conveyance roller becomes a generator to generate electromotive force. Therefore, conventionally, there is a disadvantage that it takes time to resume power supply in a case where electromotive force is generated on the load side.

As described above, in the power supply device 1 according to the present embodiment, the threshold value b, which is higher than the threshold value a, is used in the determination made when the interlock SW 15 is closed. This makes it possible to resume power supply at the time point when the interlock SW 15 is closed. That is, even in a case where an electromotive force is generated on the load side, it is possible to restart power supply at an optimal timing.

Second Embodiment

Figure 4:
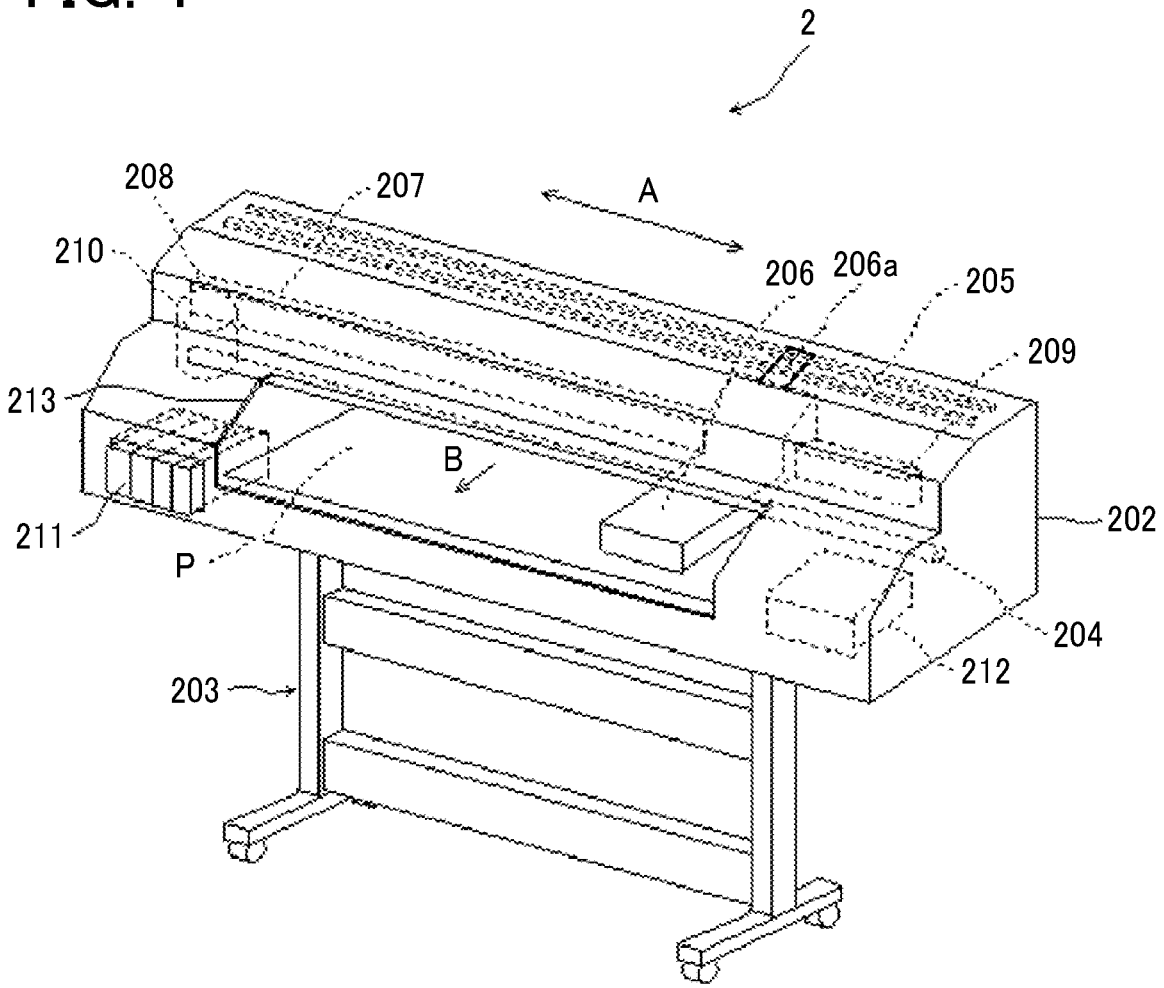
FIG. 4 is a view illustrating an example of general arrangement of an image forming apparatus according to a second embodiment.
Figure 5:
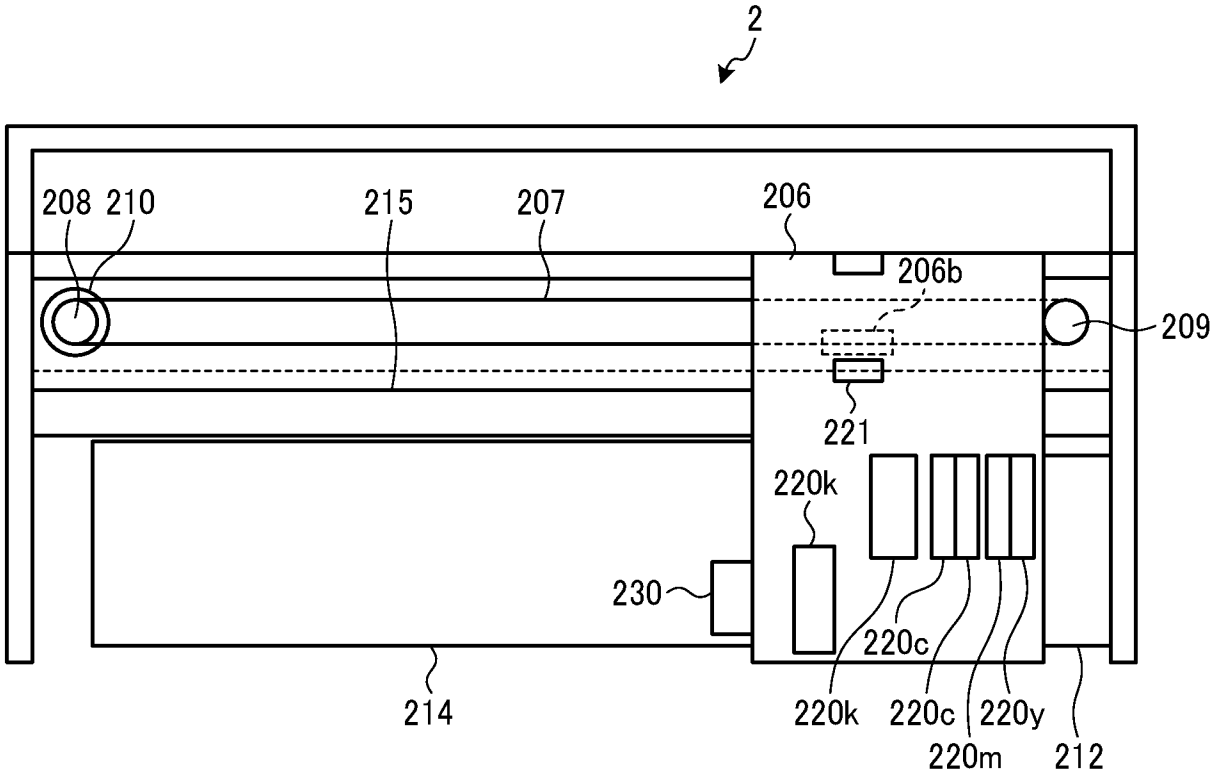
FIG. 5 is a plan view of the image forming apparatus illustrated in FIG. 4.

FIG. 4 is a view illustrating an example of general arrangement of an image forming apparatus according to a second embodiment. FIG. 5 is a plan view of the image forming apparatus illustrated in FIG. 4. An image forming apparatus 2 illustrated in FIG. 4 is an image forming apparatus of a serial type liquid discharge system (ink discharge system). A main body case 202 is disposed on a main body frame 203. The image forming apparatus 2 includes a main guide rod 204 and a sub guide rod 205 which are located in the main body case 202 and are stretched in a main-scanning direction indicated by a two-way arrow A in FIG. 4. The main guide rod 204 supports a carriage 206 in a movable manner. The carriage 206 is provided with a connecting piece 206*a* that engages with the sub guide rod 205 to stabilize the posture of the carriage 206.

In the image forming apparatus 2, an endless belt-type timing belt 207 is disposed along the main guide rod 204, and the timing belt 207 is stretched between a driving pulley 208 and a driven pulley 209. The driving pulley 208 is rotationally driven by a main scanning motor 210 and is disposed in a state of giving predetermined tension to the timing belt 207. The driving pulley 208 is rotationally driven by the main scanning motor 210 to rotationally move the timing belt 207 in the main-scanning direction according to the rotation direction of the driving pulley 208.

The carriage 206 is connected to the timing belt 207 by a belt holding section 206*b* (see FIG. 5). The driving pulley 208 rotationally moves the timing belt 207 in the main-scanning direction, and thus the carriage 206 reciprocates along the main guide rod 204 in the main-scanning direction.

In the image forming apparatus 2, a cartridge unit 211 and a maintenance mechanism unit 212 are accommodated at both end positions in the main-scanning direction in the main body case 202. The cartridge unit 211 stores cartridges that stores yellow (Y), magenta (M), cyan (C), and black (K) liquids (inks) in an exchangeable manner. The respective cartridges of the cartridge unit 211 are connected by pipes, not illustrated, to recording heads 220*y*, 220*m*, 220*c*, 220*k* (see FIG. 5) of corresponding colors of a recording head 220 mounted on the carriage 206. The respective cartridges supply liquids to the recording heads 220*y*, 220*m*, 220*c*, and 220*k* through the pipes. Note that in the following description, the recording heads 220*y*, 220*m*, 220*c*, and 220*k* are collectively referred to as a recording head 220.

While moving the carriage 206 in the main scanning direction, the image forming apparatus 2 discharges liquids on a recording medium P (such as a paper sheet) intermittently conveyed on a platen 214 (see FIG. 5) in a sub-scanning direction (arrow B direction in FIG. 1) orthogonal to the main-scanning direction. Thus, the image forming apparatus 2 outputs and records an image on the recording medium P.

That is, the image forming apparatus 2 according to the present embodiment includes a conveyer that intermittently conveys the recording medium P in the sub-scanning direction, and an image forming device that forms an image on the recording medium P while conveyance of the recording medium P in the sub-scanning direction is stopped. The image forming device includes the carriage 206, the recording head 220, and the like. While moving the carriage 206 in the main-scanning direction, the image forming device causes nozzle arrays of the recording heads 220*y*, 220*m*, 220*c*, and 220*k* to discharge liquids onto the recording medium P on the platen 214, and forms an image on the recording medium P.

The maintenance mechanism unit 212 cleans a discharge surface of the recording head 220, performs capping, discharges unnecessary liquids, and the like to discharge unnecessary liquids from the recording head 220 and to maintain reliability of the recording head 220.

The image forming apparatus 2 is provided with a cover 213 so that a conveyed portion of the recording medium P can be opened or closed. By opening the cover 213 at the time of maintenance of the image forming apparatus 2 or when paper jam occurs, it is possible to carry out work such as maintenance work of the inside the main body case 202 and removal of a jammed recording medium P. The cover 213 corresponds to an open/close door 251 which will be described later, and is an interlock.

As illustrated in FIG. 5, the carriage (moving body) 206 includes the recording heads 220*y*, 220*m*, 220*c*, and 220*k*. The recording heads 220*y*, 220*m*, 220*c*, and 220*k* are connected by the pipes to the cartridges of corresponding colors, respectively, in the cartridge unit 211, and discharge liquids in the corresponding colors onto the recording medium P facing the recording heads 220*y*, 220*m*, 220*c*, and 220*k*. That is, the recording head 220*y* discharges a yellow (Y) liquid, the recording head 220*m* discharges a magenta (M) liquid, the recording head 220*c* discharges a cyan (C) liquid, and the recording head 220*k* discharges a black (K) liquid.

The recording head 220 is mounted on the carriage 206 so that the discharge surface (nozzle surface) faces downward (recording medium P side) in FIG. 4 and discharges the liquids onto the recording medium P.

In the image forming apparatus 2, an encoder sheet 215 is disposed in parallel to the timing belt 207, that is, the main guide rod 204, at least over the movement range of the carriage 206. An encoder sensor 221 that reads the encoder sheet 215 is attached to the carriage 206. The image forming apparatus 2 controls driving of the main scanning motor 210 according to the reading result of the encoder sheet 215 by the encoder sensor 221, and thus controls movement of the carriage 206 in the main-scanning direction.

The main guide rod 204 and the sub guide rod 205 are bridged and fixed between right and left side plates 202*a* and 202*b* of the main body case 202.

As illustrated in FIG. 5, the recording head 220 mounted on the carriage 206 includes the recording head 220*y*, 220*m*, 220*c*, 220*k* each of which includes a plurality of nozzle arrays. The recording head 220 discharges liquids from the nozzle arrays onto the recording medium P conveyed on the platen 214 to form an image on the recording medium P. In the image forming apparatus 2, in order to ensure a wide width of an image that can be formed on the recording medium P by scanning performed once by the carriage 206 and to improve black printing speed, the carriage 206 includes a recording head 220 on an upstream side and a recording head 220 on a downstream side.

A reading sensor 230 is attached to the carriage 206. The reading sensor 230 reads an adjustment pattern recorded on the recording medium P at the time of an image positional deviation adjustment process.

Figure 6:
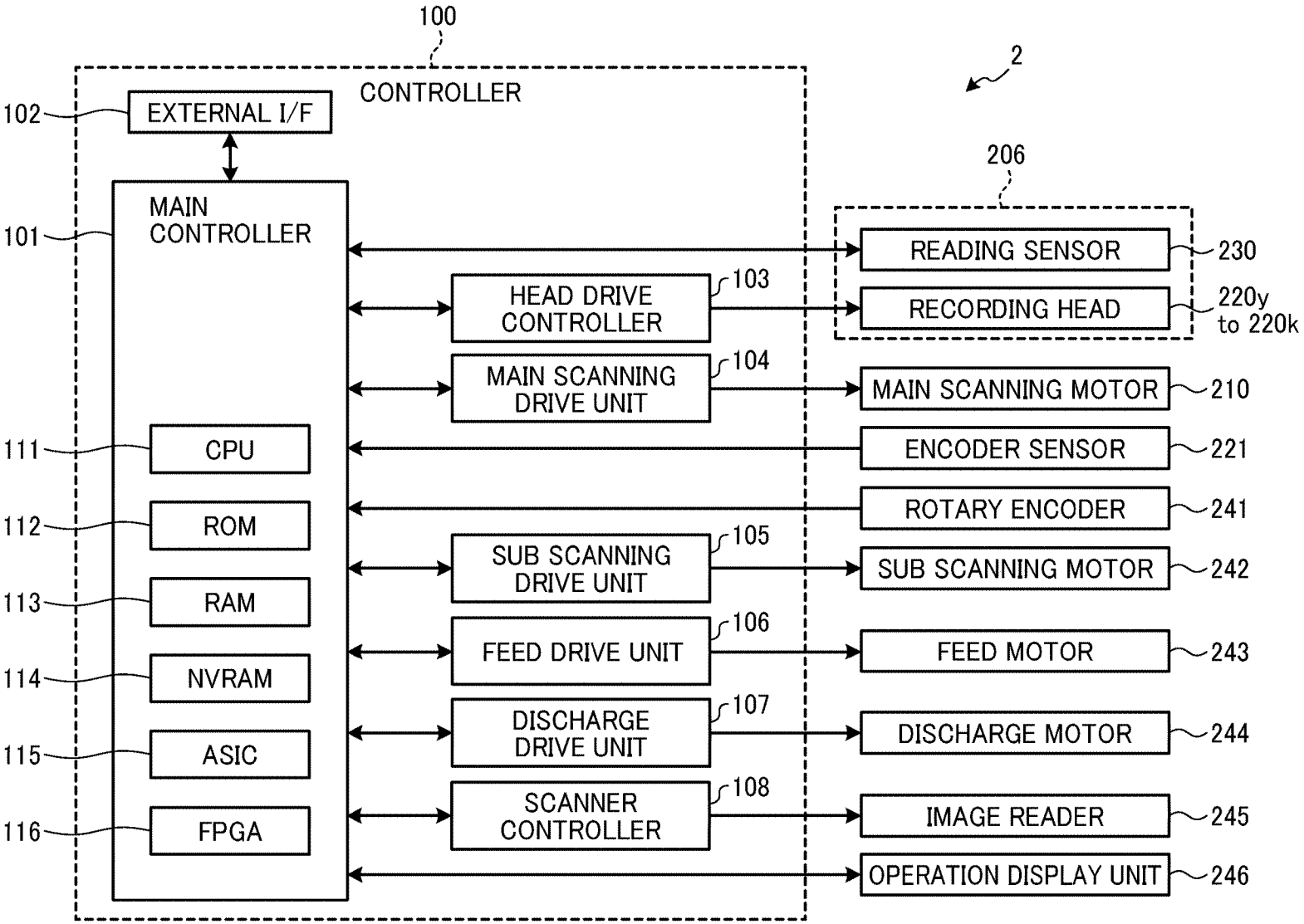
FIG. 6 is a diagram illustrating an example of block arrangement of the image forming apparatus.
Figure 7:
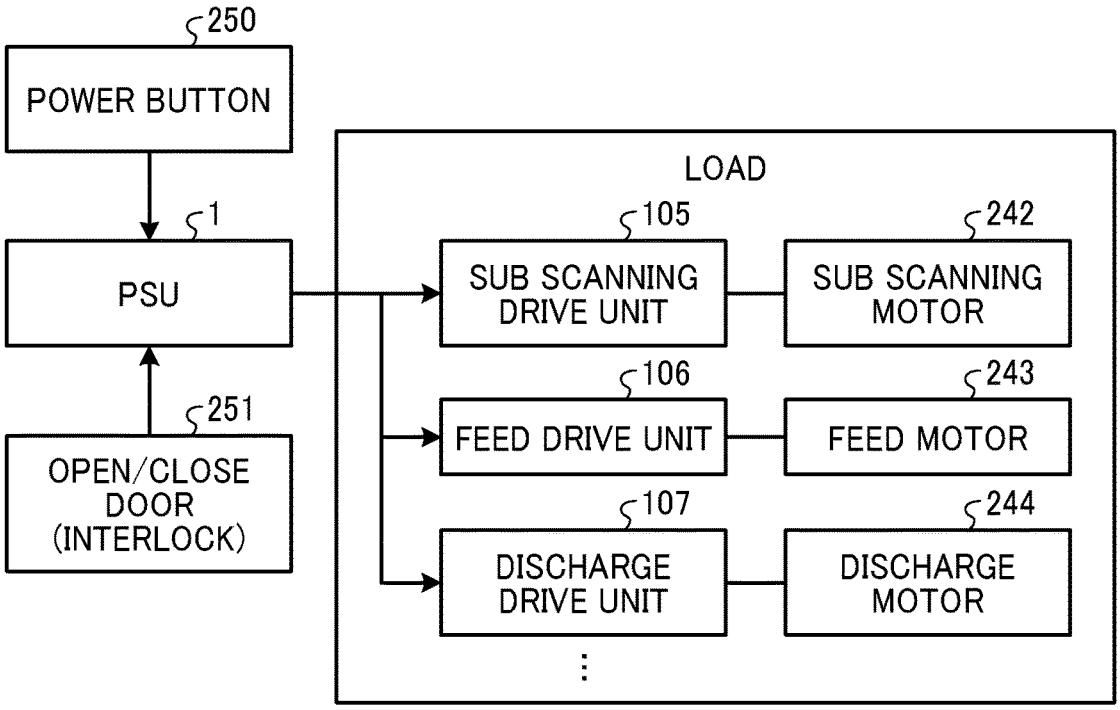
FIG. 7 is a diagram illustrating an example of a connection relationship between a PSU (power supply device) and a load or the like included in the image forming apparatus.

FIG. 6 is a diagram illustrating an example of block arrangement of the image forming apparatus 2. As illustrated in FIG. 6, the image forming apparatus 2 includes a controller 100, the carriage 206 which includes the reading sensor 230 and the recording heads 220*y* to 220*k* described above, the main scanning motor 210, the encoder sensor 221, a rotary encoder 241, a sub scanning motor 242, a feed motor 243, a discharge motor 244, an image reader 245, an operation display unit 246, and the like. In addition to the above, the image forming apparatus 2 includes a maintenance recovery motor that drives the maintenance mechanism unit 212, a recovery system drive unit that drives the maintenance recovery motor, a solenoid and the like drive unit that drives various solenoids and the like, a clutch drive unit that drives an electromagnetic clutch and the like, which are not illustrated. In the image forming apparatus 2, detection signals and the like of other various sensors are input to a main controller 101; however, are not illustrated. A power button, a power supply device, and the like are illustrated in FIG. 7 and will be described later.

The controller 100 includes the main controller 101, an external interface (I/F) 102, a head drive controller 103, a main scanning drive unit 104, a sub scanning drive unit 105, a feed drive unit 106, a discharge drive unit 107, a scanner controller 108, and the like. The main controller 101 includes a central processing unit (CPU) 111, a read only memory (ROM) 112, a random access memory (RAM) 113, a non-volatile random access memory (NVRAM) 114, an application specific integrated circuit (ASIC) 115, a field programmable gate array (FPGA) 116, and the like.

The main controller 101 stores a program and necessary data for the image forming apparatus 2 in the ROM 112. In the main controller 101, the CPU 111 uses the RAM 113 as a work memory according to the program in the ROM 112 to control the respective units of the image forming apparatus 2 and to execute processes as the image forming apparatus 2.

Under control of the CPU 111, the NVRAM 114 stores and reads data to be stored even in a case where power of the image forming apparatus 2 is turned off.

The ASIC 115 performs image processes such as various signal processes and rearrangement of image data. The FPGA 116 processes input and output signals for controlling entirety of the image forming apparatus 2.

The external I/F 102 serves an interface for communication between another device and the main controller 101 via a network such as a local area network (LAN) or a communication line such as a dedicated line, and transmits data from an external device to the main controller 101. In addition, the external I/F 102 outputs data generated by the main controller 101 to an external device. A removable storage medium can be attached to this external I/F 102. The program is distributed in a state where the program is stored in the storage medium or through a communication device from the outside.

The head drive controller 103 controls the presence or absence of liquid discharge of each of the recording heads 220*y* to 220*k*, the droplet discharge timing and the discharge amount in a case where the liquid is discharged, and causes the recording heads 220*y* to 220*k* to record an image on the recording medium P. The head drive controller 103 includes a head data generation array conversion ASIC (head driver) for controlling the driving of the recording heads 220*y* to 220*k*, and generates a drive signal indicating the presence or absence of the ink droplet and the size of the droplet according to print data (dot data subjected to a dither process or the like) to supply the drive signal to the recording heads

220*y* to 220*k*. Each of the recording heads 220*y* to 220*k* includes a switch for each nozzle. The switches are turned on/off according to the drive signal to cause a droplet of the specified size to be landed on the location on the recording medium P specified by the print data. Note that the head driver of the head drive controller 103 may be provided on the recording heads 220*y* to 220*k* side, or the head drive controller 103 and the recording heads 220*y* to 220*k* may be integrated.

Under control of the main controller 101, the main scanning drive unit (motor driver) 104 drives the main scanning motor 210 that moves the carriage 206 in the main-scanning direction to perform scanning. Therefore, the main scanning drive unit 104, the main scanning motor 210, and the like function as a moving body drive unit as a whole.

The main controller 101 receives a read result signal from the encoder sensor 221 that reads the encoder sheet 215, and the main controller 101 detects the position of the carriage 206 in the main-scanning direction according to the read result signal. Then, the main controller 101 controls the driving of the main scanning motor 210 through the main scanning drive unit 104 to reciprocate the carriage 206 to the intended location in the main-scanning direction.

The sub scanning drive unit (motor driver) 105 drives the sub scanning motor 242 that conveys the recording medium P.

The main controller 101 receives a detection signal (pulse) from the rotary encoder 241 that detects rotation of the sub scanning motor 242. The main controller 101 detects the movement amount of the recording medium P in the sub-scanning direction, that is, a medium feed amount, according to this detection signal and controls the driving of the sub scanning motor 242 through the sub scanning drive unit 105 to control conveyance of the recording medium P through a conveyance roller, not illustrated. Here, the sub scanning drive unit 105, the sub scanning motor 242, and the conveyance roller constitute part of the conveyer. In addition, the feed drive unit 106 which will be described later, the feed motor 243, a feed roller, the discharge drive unit 107, the discharge motor 244, a discharge roller, and the like, also constitute part of the conveyer.

The feed drive unit 106 drives the feed motor 243 that drives the feed roller which feeds the recording medium P from a feed tray, not illustrated.

The discharge drive unit 107 drives the discharge motor 244 that drives the discharge roller which discharges the printed recording medium P (on which an image is formed) onto a discharge tray, not illustrated. Note that the sub scanning drive unit 105 may substitute for the discharge drive unit 107. Therefore, the sub scanning drive unit 105, the sub scanning motor 242, the conveyance roller, the feed drive unit 106, the feed motor 243, the feed roller, the discharge drive unit 107, the discharge motor 244, the discharge roller, and the like as a whole function as the conveyer that conveys the recording medium P.

The scanner controller 108 controls drive operation of the image reader 245. For example, an image scanner using a charge coupled device (CCD) or a complementary metal oxide semiconductor (CMOS) is used as the image reader 245. The image reader 245 scans an original, reads an image of the original at predetermined resolution, and outputs the read image to the scanner controller 108.

The operation display unit 246 includes various keys necessary for causing the image forming apparatus 2 to perform various operations, and also includes a display (for example, a liquid crystal display) or a lamp such as a light emitting diode (LED). When various operations for causing the image forming apparatus 2 to perform various function operation processes are performed through operation keys, the operation display unit 246 passes operation content to the main controller 101. In addition, the operation display unit 246 causes the display to display information delivered from the main controller 101, that is, instruction content input from the operation key and various information which a user is notified of by the image forming apparatus 2. In particular, the operation display unit 246 performs various setting operations necessary for the image positional deviation adjustment process described later.

FIG. 7 is a diagram illustrating an example of a connection relationship between a PSU (power supply device) and the load or the like included in the image forming apparatus 2. FIG. 7 illustrates, as an example of the load connected to the PSU, conveyance motors and various drive units provided in the conveyer for the recording medium. The others are not illustrated.

As illustrated in FIG. 7, the PSU 1 receives a power ON/OFF signal through operation of a power button 250 of the image forming apparatus 2. According to opening and closing of the open/close door 251, the interlock mechanism operates to switch the interlock SW 15. The PSU 1 operates at similar timings as the timings of the power supply device described in the first embodiment. That is, when the open/close door 251 is opened due to a paper jam process or the like, the recording medium is manually pulled out from the conveyance path, and then the open/close door 251 is closed, the PSU 1 compares the voltage of the power supply line with the threshold b to immediately resume the supply of voltage to the conveyer and the like.

In the present embodiment, the image forming apparatus of a serial-type liquid discharge system is described as an example of the image forming apparatus; however, the image forming apparatus is not limited to this. As long as an image forming apparatus includes a winding load on the load side of a power supply device to generate electromotive force, the present invention is applicable to any image forming apparatus. For example, an MFP including a mechanism for conveying a paper sheet falls under this.

Third Embodiment

The power supply device described in the first embodiment can be mounted on various types of conveyance apparatuses. For example, since the image forming apparatus described as an example in the second embodiment includes a conveyer, the image forming apparatus is also included in one of the conveyance apparatuses. In addition to such a conveyance apparatus that conveys a paper sheet, as long as a conveyance apparatus includes a winding load such as a motor to generate electromotive force, the power supply device can be appropriately applied to a conveyance apparatus that conveys another object to be conveyed. For example, the present invention can be applied to a conveyance apparatus (such as an automatic teller machine) that conveys bills, a conveyance apparatus that conveys a film, a conveyance apparatus that conveys a sheet, and the like.

Figure 8:
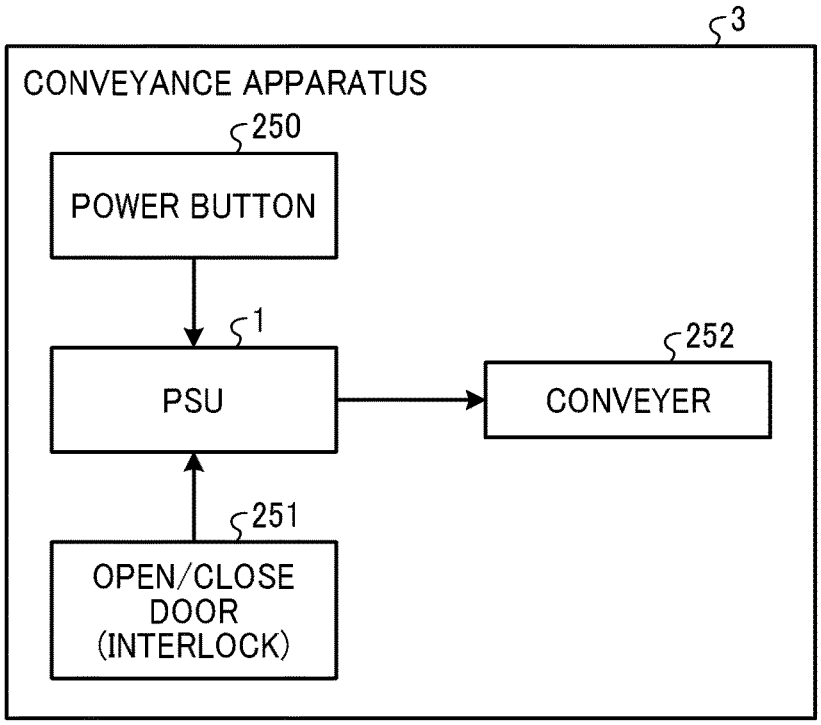
FIG. 8 is a diagram illustrating an example of arrangement of a conveyance apparatus according to a third embodiment.

FIG. 8 is a diagram illustrating an example of the arrangement of a conveyance apparatus according to a third embodiment. A conveyance apparatus 3 illustrated in FIG. 8 includes a PSU 1, a conveyer 252, and the like. As the conveyer 252, various conveyance motors and drive units for conveying an object to be conveyed can be applied. The conveyance apparatus 3 corresponds to part of the image forming apparatus 2 related to conveyance described in the second embodiment, and as an example, is similar to the part described in the second embodiment. Note that the conveyer 252 is not limited to the conveyer described in the second embodiment, and the design and the combination may be changed as appropriate according to an object to be conveyed, an intended use, and the like.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A power supply device comprising:
a power supply line configured to supply a voltage from a first power supply unit to a load;
control circuitry configured to control voltage supply from the first power supply unit; and
a first switch connected between a second power supply unit and the control circuitry,
wherein the control circuitry is configured to:
cause the first power supply unit to start the voltage supply on condition that the first switch is in a closed state and a voltage of the power supply line is not greater than a first threshold voltage; and
cause the first power supply unit to start the voltage supply on condition that the voltage of the power supply line is not greater than a second threshold voltage higher than the first threshold voltage when the first switch changes from an open state to the closed state.

2. The power supply device according to claim 1,
wherein in a case where the first switch is in the open state, the control circuitry does not cause the first power supply unit to supply the voltage when the voltage of the power supply line is not greater than the second threshold voltage.

3. The power supply device according to claim 1, further comprising:
a second switch connected between the power supply line and the load; and
a rectifier connected in parallel to the second switch,
wherein the control circuitry controls the second switch to start the voltage supply from the first power supply unit.

4. The power supply device according to claim 3,
wherein the rectifier is configured to cause a current flow from the load to the first power supply unit.

5. The power supply device according to claim 3,
wherein the rectifier is a diode.

6. The power supply device according to claim 1,
wherein the second threshold voltage is higher than an electromotive force of a winding load of the load.

7. The power supply device according to claim 1, further comprising a variable device configured to vary the second threshold voltage.

8. An image forming apparatus comprising:
the power supply device according to claim 1;
a conveyer configured to convey a recording medium; and
an image forming device configured to form an image on the recording medium.

9. A power supply device comprising:
a first power supply unit;
a second power supply unit;
a motor unit configured to receive a voltage supplied from the first power supply unit;
a power supply line connected to the motor unit and the first power supply unit;
a control unit connected to the first power supply unit; and
a first switch connected between the second power supply unit and the control unit, the control unit configured to:
cause the first power supply unit to supply the voltage to the power supply line in a case where the voltage supplied from the second power supply unit is shut off by the first switch and a voltage of the power supply line is not greater than a first threshold voltage; and
cause the first power supply unit to supply the voltage to the power supply line in a case where the voltage of the power supply line is not greater than a second threshold voltage, which is greater than the first threshold voltage when the switch changes from a shutoff state to a connection state in which the voltage from the second power supply unit is supplied.

10. The power supply device according to claim 9, further comprising:
a second switch connected between the power supply line and the motor unit; and
a rectifier connected in parallel to the second switch,
wherein the control circuitry changes the second switch to a connection state to supply the voltage from the first power supply unit to the motor unit.

11. The power supply device according to claim 10,
wherein the rectifier is configured to cause a current flow from the motor unit to the first power supply unit.

12. The power supply device according to claim 10,
wherein the rectifier is a diode.

13. The power supply device according to claim 9,
wherein the control unit includes a variable device to vary the second threshold voltage.

14. The power supply device according to claim 13,
wherein the variable device is a variable resistor.

15. The power supply device according to claim 9,
wherein the motor unit is a motor.

16. The power supply device according to claim 9,
wherein the motor unit includes a plurality of different types of motors.

17. The power supply device according to claim 9,
wherein the motor unit is a conveyer.

* * * * *